US008172645B2

(12) United States Patent
Ganshof

(10) Patent No.: US 8,172,645 B2
(45) Date of Patent: May 8, 2012

(54) DOSING DEVICE

(75) Inventor: Nicolas Ganshof, Morges (CH)

(73) Assignee: Swiss Industrial Consulting and Technology SA, Morges (CH)

( * ) Notice: Subject to any disclaimer, the term of this patent is extended or adjusted under 35 U.S.C. 154(b) by 749 days.

(21) Appl. No.: 12/281,636

(22) PCT Filed: Mar. 19, 2007

(86) PCT No.: PCT/EP2007/002421

§ 371 (c)(1),
(2), (4) Date: Dec. 3, 2008

(87) PCT Pub. No.: WO2007/107322

PCT Pub. Date: Sep. 27, 2007

(65) Prior Publication Data

US 2009/0197511 A1 Aug. 6, 2009

(30) Foreign Application Priority Data

Mar. 20, 2006 (EP) ..... 06394007

(51) Int. Cl.
*B24C 5/06* (2006.01)
*B24C 7/00* (2006.01)

(52) U.S. Cl. ..... 451/38; 451/98; 451/99

(58) Field of Classification Search ..... 451/38, 451/39, 99–102, 86, 95, 97, 98; 222/197, 222/345, 367, 368; 198/701, 714
See application file for complete search history.

(56) References Cited

U.S. PATENT DOCUMENTS

| | | | | |
|---|---|---|---|---|
| 1,437,863 | A | 12/1922 | Raymond | |
| 2,684,788 | A * | 7/1954 | Bland | 222/623 |
| 2,907,444 | A | 10/1959 | Smith | |
| 3,758,004 | A * | 9/1973 | Garrett et al. | 222/231 |
| 3,970,224 | A * | 7/1976 | Chatham et al. | 222/370 |
| 4,155,486 | A * | 5/1979 | Brown | 222/197 |
| 4,267,946 | A | 5/1981 | Thatcher | |
| 5,109,636 | A | 5/1992 | Lloyd et al. | |

FOREIGN PATENT DOCUMENTS

| | | |
|---|---|---|
| DE | 19541228 | 5/1997 |
| DE | 3616188 | 9/2008 |
| GB | 1499551 | 2/1978 |
| WO | 91/04449 | 4/1991 |

* cited by examiner

*Primary Examiner* — Dung Van Nguyen
(74) *Attorney, Agent, or Firm* — David S. Resnick; Nixon Peabody LLP

(57) ABSTRACT

The invention provides a dosing device for a particulate material blasting apparatus comprising a dosing chamber having a base, a rotor carrying a plurality of circumferentially formed pockets ratably mountable with the chamber, a particulate product feed conduit adapted to feed particulate product onto a base of the dosing chamber adjacent a receiving side of the dosing chamber and a particulate product delivery conduit formed in the base of the dosing chamber adjacent a delivery side of the dosing chamber. The base of the dosing chamber is disposed with respect to the particulate product feed conduit such that particulate material will not spill over the base into the delivery conduit. The rotor is disposed with respect to the feed conduit such that particulate product fed onto the base of the dosing chamber will be picked up by the pockets formed in the rotor and lifted up and around the chamber from a receiving side of the dosing chamber to a delivery side of the dosing chamber.

9 Claims, 7 Drawing Sheets

DOSING DEVICE

CROSS-REFERENCE TO RELATED APPLICATIONS

This application is a 371 National Stage of International Application No. PCT/EP2007/002421 filed on Mar. 19, 2007, which designates the United States, and which claims the benefit under 35 U.S.C. §119(a) of European Application No. 06394007.6 filed on Mar. 20, 2006, the entire contents of which are incorporated herein by reference.

INTRODUCTION

The invention relates to a dosing device for a particulate blasting apparatus. In particular, the invention relates to a particulate blasting apparatus, especially a blasting apparatus for non-abrasive particulate material.

Dosing devices for non-abrasive blasting are known and generally comprise a product feed conduit, a dosing chamber for metering the blasting media, and a pressurised fluid line into which the metered media is dosed. The mixture of metered media and fluid are fed under pressure to a dispensing nozzle. Conventional dosing systems use a pressure differential to meter the amount of media charged into the fluid. An advantage of such a system is that it can be used with both abrasive and non-abrasive material; a disadvantage is that the accuracy of dosing is poor. In an attempt to address the dosing accuracy problem, the Applicant devised a dosing device comprising a spinning disk with a hole, wherein media is dosed when the hole rotates into register with media feed and supply conduits. An example of such a device is described in U.S. Pat. No. 6,896,197. With this type of device, a seal is required between spinning disk and the plates between the disk is mounted to prevent seepage of media when the disk is not operational. As the adjustment between the disk and the plates has to be very small, the seal is rapidly destroyed due to the friction between the disks and the plates; this problem is exacerbated by the media which has an abrasive effect on the disks and plates, resulting in the device only being usable with non-abrasive material.

U.S. Pat. No. 3,758,004 describes a dosing device for particulate material having a dosing chamber within which is mounted a rotatable rotor for delivery of particulate material into a dispensing outlet. The device is designed with very close tolerances between the periphery of the rotor and the walls of the dosing chamber to avoid passage of particulate material into the dispending outlet when the rotor is not turning. Such close tolerances cause friction and wear on the adjacent surfaces of the rotor and the dispensing chamber, which problems are exacerbated by any media which falls into tight gaps between the surfaces.

It is an object of the invention to overcome at least one of the above problems.

STATEMENTS OF INVENTION

The present invention provides a dosing device for particulate material having a dosing chamber with a material receiving side, a material dispensing side, and a rotor interposed between the dispensing and receiving sides. Material is delivered onto a base of the material receiving side by a feed conduit, and rotation of the rotor lifts the material up (typically in a scooping action) from the receiving side and delivers it to the delivery side of the dosing chamber. The base of the material receiving side is disposed with respect of the feed conduit such that particulate material will not spill into the delivery side of the dosing chamber when the rotor is static. This enables the device to be made without close tolerances between the rotor and the adjacent walls of the dosing chamber (i.e. typically they are not sealed), thereby minimising wear and tear on these components.

According to the invention, there is provided a dosing device, especially a dosing device suitable for a particulate material blasting apparatus, comprising:

- a dosing chamber having a base, a material receiving side and a material delivery side;
- a feed conduit adapted to feed material onto a base of the dosing chamber at the material receiving side of the dosing chamber;
- a delivery conduit formed in the dosing chamber at the material delivery side of the dosing chamber; and
- a rotor rotatably mountable with the chamber, the rotor comprising a series of scooping pockets mounted along a circumference of the rotor, wherein the rotor is disposed within the dosing chamber such that upon rotation the pockets lift material up from the base of the dosing chamber and deliver it to the delivery side of the dosing chamber where it falls into the delivery conduit, and wherein the base is disposed with respect to the feed conduit such that material delivered onto the base from the feed conduit will not spill into the delivery conduit when the rotor is static.

A device formed according to the invention has distinct advantages compared to conventional particulate material dosing devices. First, due to the disposition of the base of the dosing chamber and a mouth of the delivery conduit, particulate material will not spill under its own forces over the edge of the base of the material receiving side of the dosing chamber into the material delivery side. Rather, when the device is charged with material it will settle in the receiving side of the dosing device into a "cone" of material where a foot of the cone does not extend over the edge of the base of the device. Thus, when the rotor is removed, or when it is static (i.e. when not in use), material will not spill under its own forces over into the delivery side of the chamber. This allows the device to be designed without small or tight tolerances between the periphery of the rotor and the walls of the dosing device, which means that wear and tear on these moving parts is minimised.

Suitably, there is no seal formed between the product feed conduit and the product delivery conduit. Again, this minimises wear and tear on the rotor and adjacent walls of the dosing chamber.

In one embodiment of the invention, the base of the dosing chamber on a delivery side of the chamber is raised to form a lip. When employed, this lip has the effect of holding back material from spilling over into the material delivery side of the dosing device. Typically, the base of the dosing chamber on a delivery side of the chamber substantially follows the curvature of the rotor. Generally, the rotor is mounted within the chamber adjacent the base of the chamber and adjacent a mouth of the product feed conduit.

In one embodiment, a mouth of the feed conduit adjacent the dosing chamber has an upper lip, wherein a line drawn between the upper lip and an edge of the base forms an angle $\theta$ with the horizontal, and wherein $\theta$ is less than 30°. Typically, the angle $\theta$ is less than 28°, preferably less than 25°, more preferably less than 24°, more preferably less than 21°. It will be appreciated that the angle $\theta$ may be varied according to the material being dispensed. The variation depends on the characteristics of the material, and the dimensions of the "cone" of the material when it is allowed to settle on a flat surface. Obviously, the steeper the "cone" of the material, the higher the angle θ may be. The figures provided above are figures typically employed when the material being dispensed is Exa HDO™ precipitated calcium carbonate, or a similar material.

The rotor is generally mounted for rotation such that the material is lifted up from the receiving side of the dosing chamber and carried up and around into the delivery side of the dosing chamber. Thus, the rotor is typically mounted on a horizontal axis, although the axis does not have to be exactly horizontal.

Typically, each pocket comprises a tooth-like formation which projects from a circumference of the rotor. However, it will be appreciated that the pockets may take any form so long as they perform the function of lifting the material up from the receiving side of the dosing device and carrying it to the delivery side of the dosing chamber where it is dispensed into the delivery conduit. Thus, in an alternative embodiment, the pockets may be formed by vanes extending substantially radially from the rotor, or by a wheel having scoop-like formation, or indeed any formation that is capable of carrying the material up and around the dosing chamber into the delivery side.

In a preferred embodiment, the device comprises at least two series of scooping pockets mounted along the circumference of the rotor. Ideally, the pockets of one series are circumferentially staggered with respect to the pockets of the other series. In an ideal embodiment, the rotor comprises three series of circumferential scooping pockets, each series circumferentially staggered with respect to the other. In this manner, adjacent pockets on each series of pockets will deliver particulate material in a phased manner, and not all at the same time. This ensures that delivery of particulate material into the product delivery conduit is reasonably consistent and smooth, as opposed to an intermittent delivery which would result if only one series of pockets is employed.

In an alternative embodiment of the invention, the device comprises a plurality of rotors. Suitably, the series of scooping pockets of one rotor are circumferentially staggered with respect to those of the other rotor(s).

The invention also relates to a particulate material blasting apparatus comprising a dosing device according to the invention. Typically, such an apparatus will comprise means for engaging a reservoir of particulate material and delivering the particulate material in the reservoir to the material feed conduit. Typically, the engagement means is adapted for sealing engagement with the particulate material feed conduit. Generally, the particulate product delivery conduit feeds into a fluid supply line, ideally a pressurised fluid line, to form an output line. The apparatus will also generally include means for generating a pressurised feed of fluid in the pressurised fluid line. Preferably, the fluid will be gaseous, ideally air. Typically, the fluid pressure is equalised throughout the apparatus, i.e. the pressure in the particulate material reservoir, the feed conduit, the dosing chamber, and the delivery conduit are all substantially the same. In one embodiment, this equalisation of pressures is ensured by the provision of an air pressure equalisation conduit adapted to provide fluid communication between the dosing chamber and the particulate material storage chamber. Typically, one end of the air pressure equalisation conduit is located within the particulate material storage chamber adjacent a mouth of the storage chamber.

Suitably, the air pressure in the output line is between 0 and 10 Bars. Typically, the output line is in fluid communication with a dispensing nozzle which, in use, is operated to direct the stream of fluid and particulate material to a desired target.

The invention also relates to a method of dosing particulate material which employs a particulate material blasting apparatus according to the invention, which method comprises the steps of providing a reservoir of particulate material, feeding the particulate material into the dosing chamber through the feed conduit, actuating the motor to rotate the rotor at a desired speed corresponding to the desired material dosing rate, and carrying out a blasting operation by employing the nozzle to direct the stream of fluid and particulate material at a desired target.

DESCRIPTION OF THE FIGURES

The invention will be more clearly understood from the following description of an embodiment thereof, given by way of example only, in which.

DETAILED DESCRIPTION OF THE INVENTION

Figure 1:
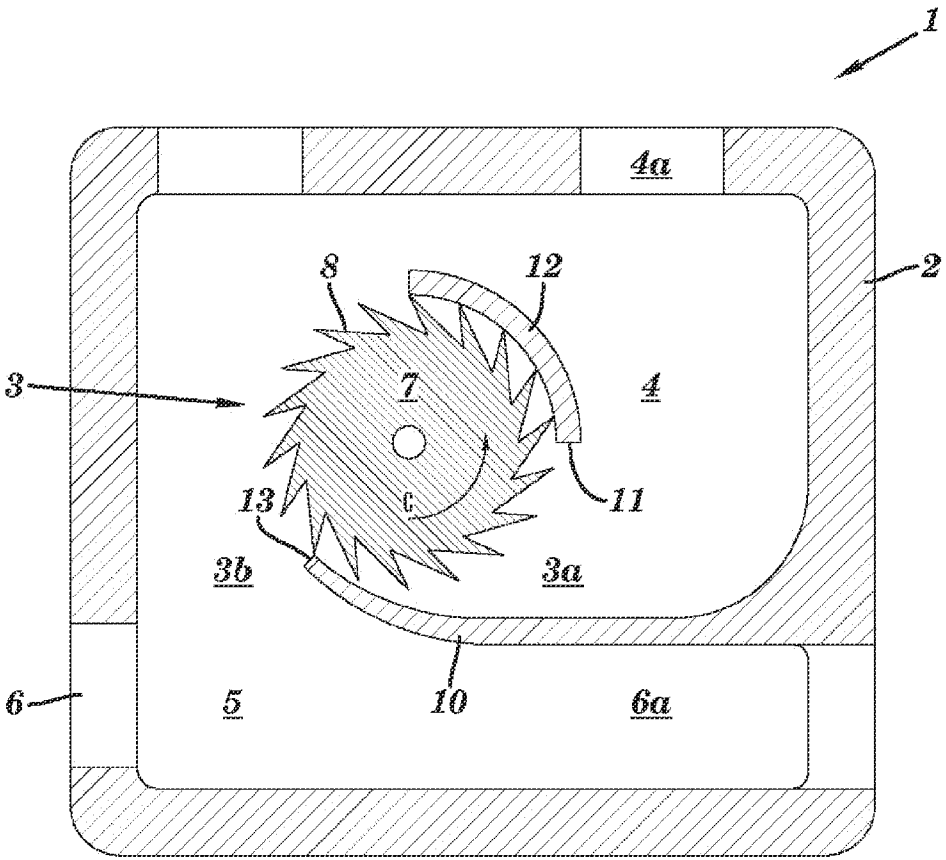
FIG. 1 is a sectional view of a side elevation of a dosing device according to the invention.

Referring to the drawings, there is illustrated a dosing device for a particulate material blasting apparatus according to the invention, indicated generally by the reference numeral 1, and comprising a main unit body 2 housing a dosing chamber 3, a product feed conduit 4, and a product delivery conduit 5. The dosing chamber 3 has a product receiving side 3*a* and a product delivery side 3*b*.

As shown in FIG. 1, the product delivery conduit 5 feeds into a pressurised air supply line 6 which forms a product outlet 6*a*. Although not shown in the Figures, the product outlet line 6*a* feeds into a dispensing nozzle.

Figure 2:
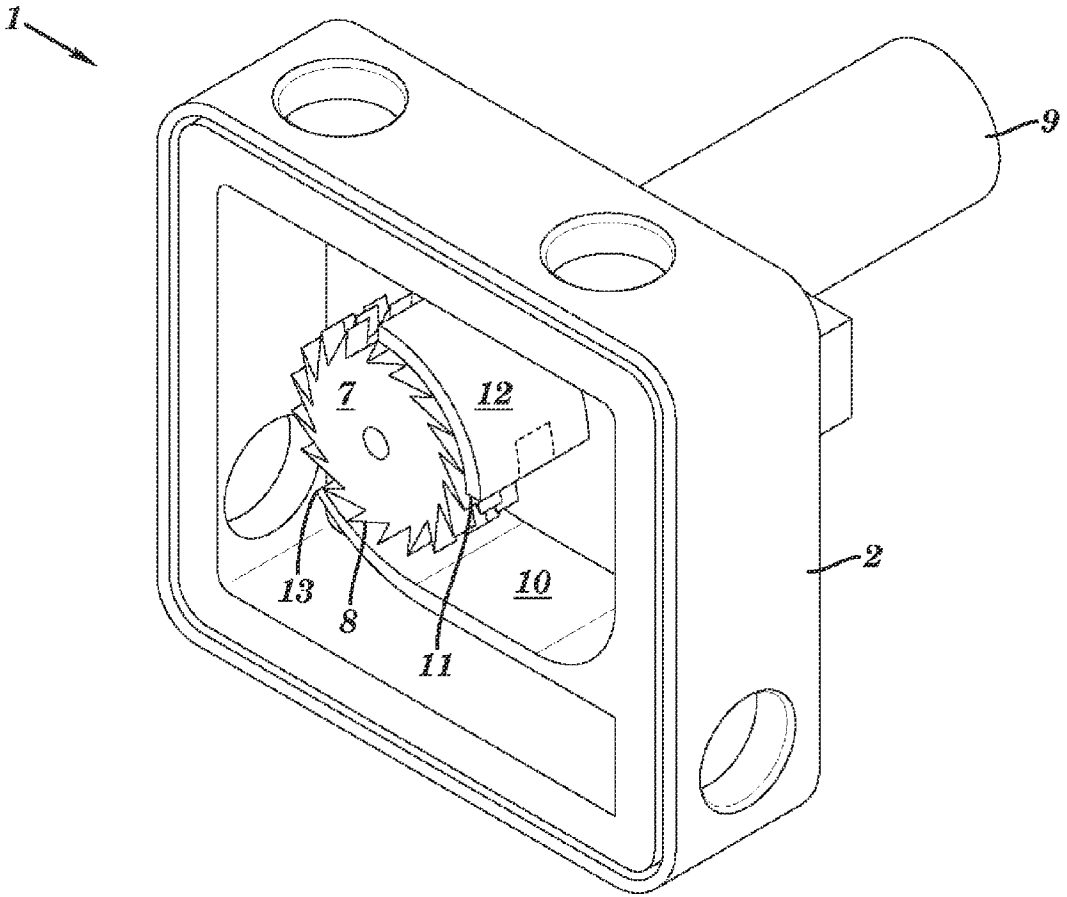
FIG. 2 is a perspective view of the device of FIG. 1.

In more detail, a rotor 7 having a plurality of circumferentially formed pockets 8 is rotatably mounted within the dosing chamber 3. Each pocket 8 is formed by a tooth-like formation which extends from a circumference of the rotor 8. As is illustrated in FIGS. 2 and 4, the rotor 7 includes three series of pockets 8 that are staggered circumferentially with respect to each other. However, as an alternative embodiment (see FIG. 3), three separate rotors 7*a*, 7*b* and 7*c* may be provided and arranged such that the pockets in the rotors are circumferentially staggered. The rotor 7 includes an axle 7*d* which engages with a motor 9 for rotation of the rotor 7. The speed of rotation of the rotor 7 may be decided by the operator according to the blasting conditions required.

Figure 3:
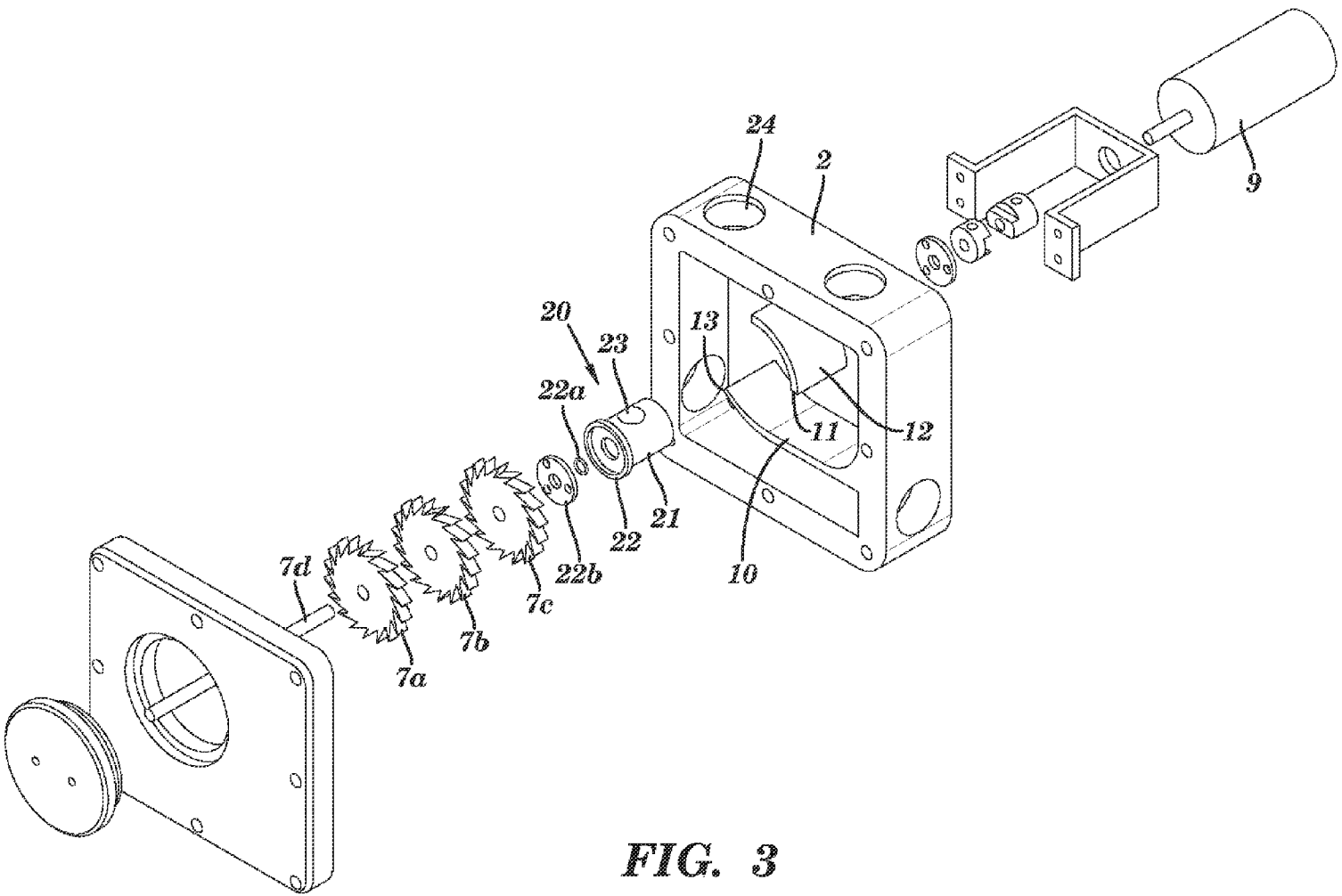
FIG. 3 is an exploded perspective view of the dosing device of FIG. 1
Figure 4:
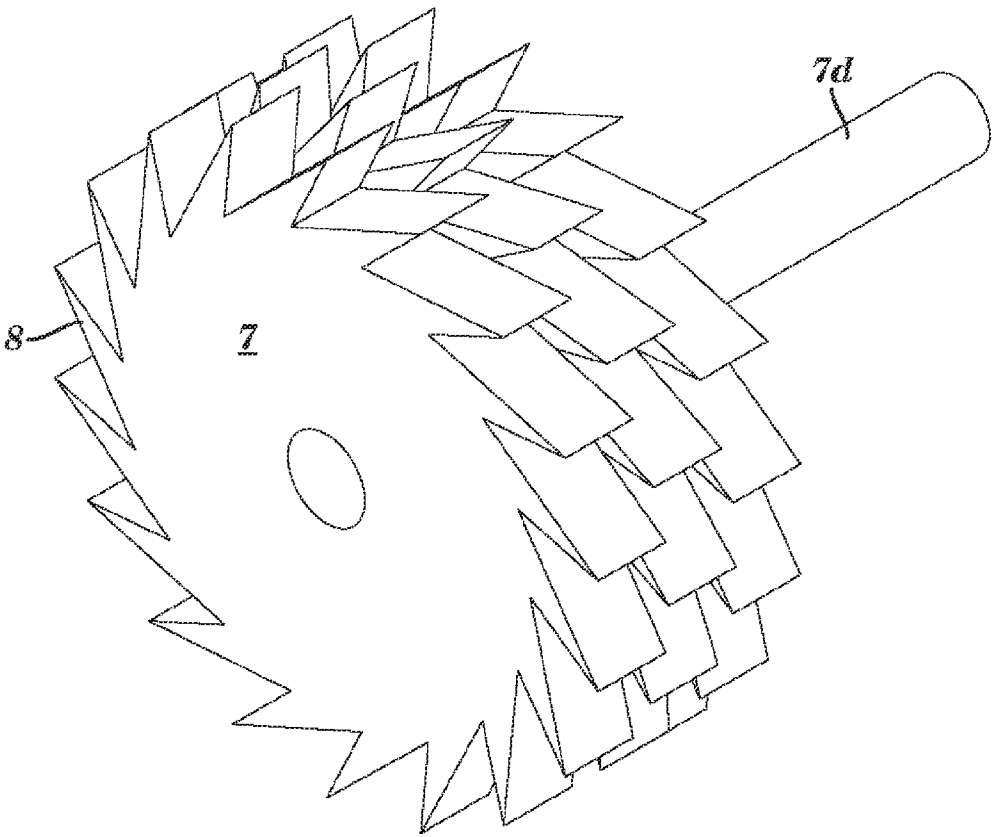
FIG. 4 is a perspective view of a rotor forming part of a dosing device according to the invention.

As is illustrated in FIG. 3, the axle 7*d* passes through an axle housing 20 which itself traverses the wall of the dosing device 1. The housing 20 comprises a cylindrical body 21 having a flanged end 22. In use, the housing is placed in a hole in the wall of the device 1 with the flanged end 22 engaging the inner wall and the cylindrical body extending through the hole. The axle is then passed through the body 21 and the remaining parts of the housing, including a o-ring seal 22*a* and an end cap 22*b*, are attached before the axle is attached to the motor. An air pressure line is than attached to the aperture 23 in the cylindrical body and air pressure greater than or equal to that in the dosing device is applied to an interior of the housing, externally of the doing chamber. This ensures that the amount of particulate material which escapes from the dosing chamber through the axle hole is minimised, thereby reducing wear on the seal 22*a*.

The product feed conduit 4 formed in the main unit body 2 comprises a passage which at one end 4*a* is adapted for sealing engagement with a particulate material container. An opposite end of the conduit 4 feeds in to the product receiving side 3*a* of the dosing chamber 3. A baffle 12 forms a barrier between the dosing chamber 3 and the product feed conduit 4. A mouth of the product feed conduit 4 has an upper lip 11. The product delivery conduit 5 comprises an aperture in the base 10 on the product delivery side 3*a* of the dosing chamber 3.

The base 10 of the 3 chamber curves upwardly on a product delivery side of the chamber 3 and forms a base lip 13 adjacent the product delivery conduit 5. A line drawn between the upper lip 11 of the feed conduit aperture and the base lip 13 is indicated by the reference numeral A. An angle between line A and the horizontal is indicated by the symbol θ (See FIG. 6). In the embodiment shown, θ is 23°. Generally, θ must be less than 30° as otherwise, and due to the clearance between the rotors and the sidewalls and base of the dosing chamber, the particulate material will spill over the base lip 13 into the product delivery conduit 5 when the rotor is not being operated. In an alternative embodiment, the baffle 12 may include a cut-out to enhance delivery of particulate material into the pockets of the rotor. Such as cut-out is illustrated with a broken line in FIG. 2. In this instance, the cut-out does not effect the angle θ, as this angle is determined by the lowest part of the baffle 12 at the sides of the lip 11.

The rotor 7 is positioned with respect to the product feed conduit 4 and the base 10 such that upon rotation it scoops up particulate product delivered to the base through the product feed conduit 4.

The dosing device 1 additionally includes an aperture 24 which is adapted for connecting with an air pressure equalisation conduit (see below).

Figure 5:
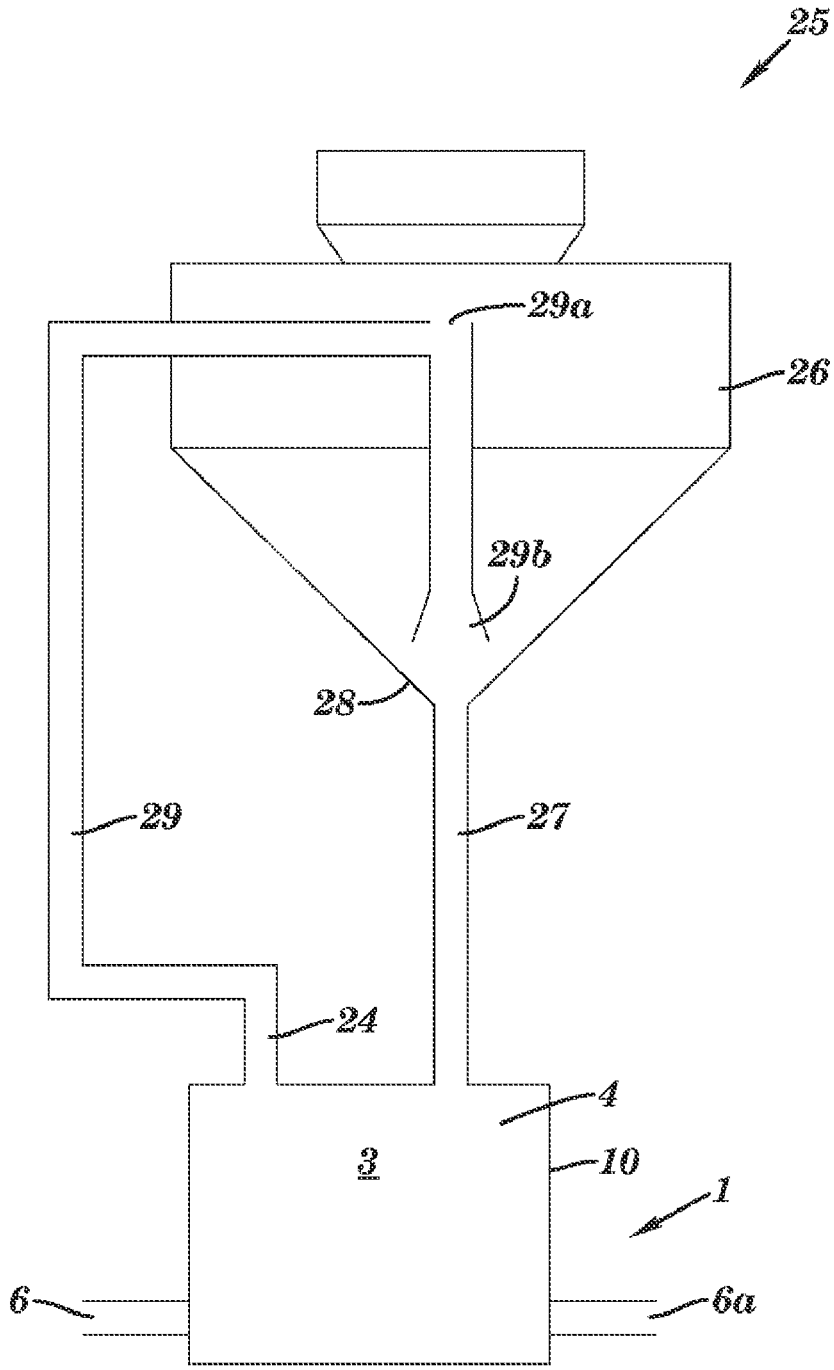
FIG. 5 is a schematic view of a particulate blasting apparatus according to the invention.

Referring to FIG. 5 there is illustrated a schematic drawing of a particulate material blasting apparatus according to the invention and indicated generally by the reference numeral 25. A product reservoir container 26 is located above the dosing device 1 and includes a conduit 27 providing a passage through which product can pass from the base 28 of the container 26 to the product feed conduit 4 under the force of gravity. An air pressure equalisation conduit 29 provides fluid communication between the dosing chamber 3 and the container 26. The conduit 29 has an upper opening 29*a* located at a top of the container and a lower opening 29*b* located towards a base of the container 26. This seeks to ensure that the pressure within the reservoir container 26 does not fluctuate greatly compared with the pressure within the dosing chamber and product feed and delivery conduits.

Figure 6:
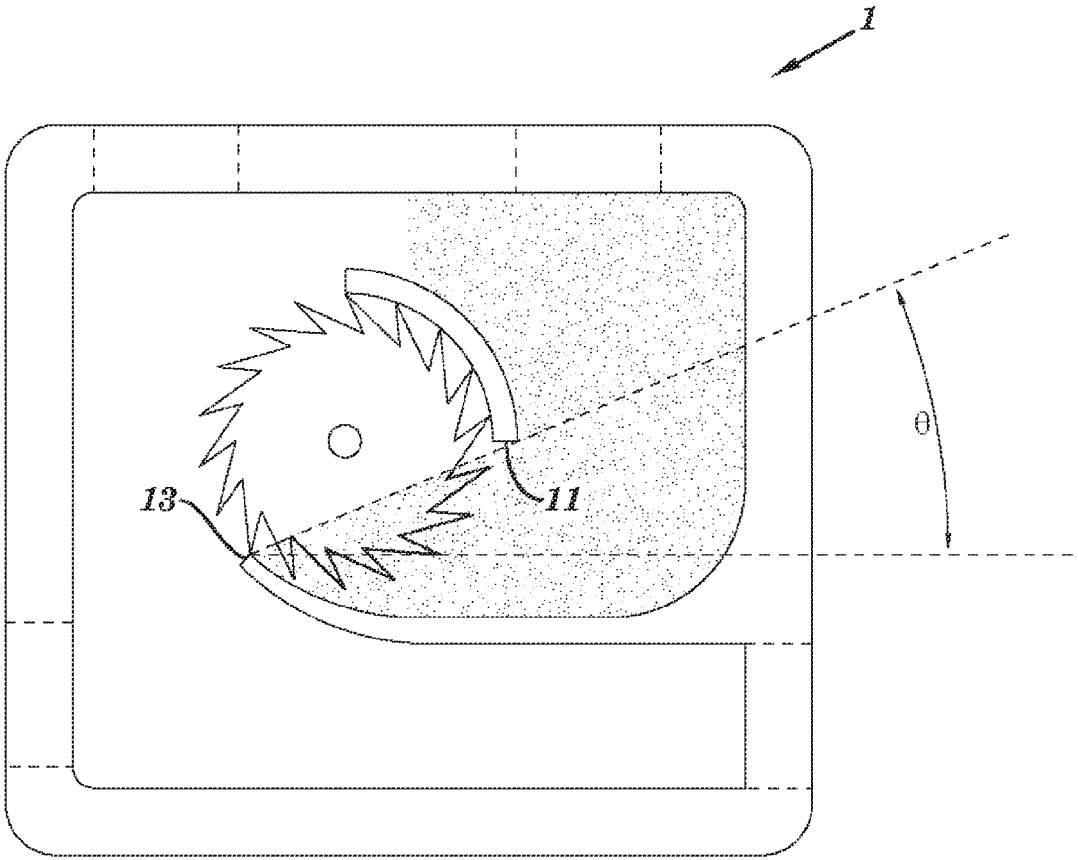
FIG. 6 is an illustration of the dosing device of FIG. 1 charged with particulate material.

In use, a particulate material such as particles of agglomerated calcium carbonate is fed into the product feed conduit 4 from the product reservoir container 26 in sealing engagement with the conduit 4. The product will charge the conduit 4 and come to rest on the base 10 of the chamber 3. Referring to FIG. 6, there is illustrated a schematic figure of the dosing device charged with particulate material; as can be seen, when the angle θ is sufficiently shallow (less than 30°, the material will not spill over the lip of the base of its own accord. Thus, the only route for material from the product receiving side of the chamber to the product delivery side is through rotation of the rotor. A further advantage of this system is that when the rotor is not turning, the material will simply sit on the base of the device; no sealing between the product receiving and product delivery sides is required. Thus, the wear and tear that the moving parts of the device are exposed to is minimised.

Due to the disposition of the rotor 7 with respect to the conduit 4 and the base 10, rotation of the rotor 7 (in the direction of the arrow marked C in FIG. 1) results in product being scooped up and lifted upwards in the circumferential pockets 8 and delivered from a product receiving side 3*a* of the chamber to a product delivery side 3*b* of the chamber where the product falls into the product delivery conduit 5 and is delivered into the air supply line 6 to form the product outlet 6*a*. Depending on the type of blasting operation required, the air pressure in the air supply line 6 may be varied, and the amount of particulate product metered into the outlet may be varied by varying the speed of the rotor.

Figure 7:
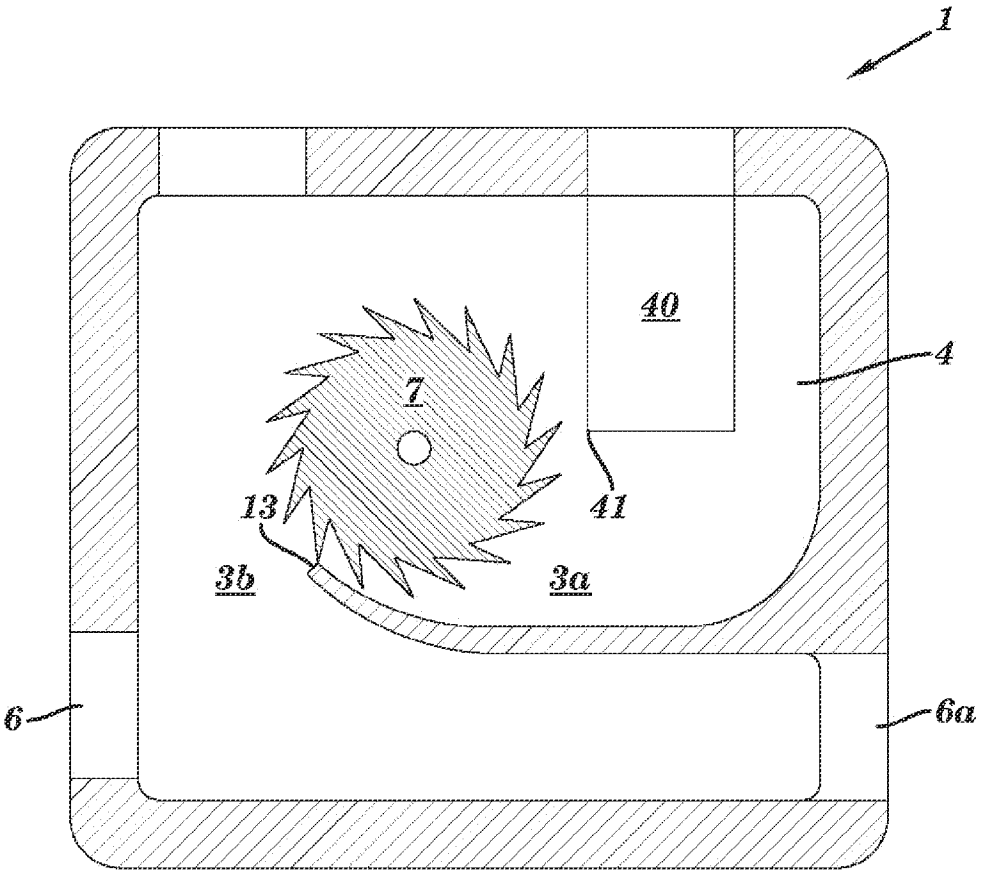
FIG. 7 is a sectional view of a side elevation of a dosing device according to an alternative embodiment of the invention.

Referring to FIG. 7, there is illustrated a further embodiment of the dosing device of the invention in which parts similar to those identified with reference to the previous embodiment are assigned the same reference numerals. In this embodiment, part of the product feed conduit 4 comprises a cylindrical tube 40 which extends from the top 4*a* of the conduit 4 towards the base 10 of the dosing chamber. The use of this embodiment is substantially identical to that described for the previous embodiment.

Due to the manner of operation of the device, all the conduits and chambers of the device may have the same operating pressure. This obviates the need for a seal between the product feed conduit and the product delivery conduit, and therefore reduces the friction applied to the working surfaces of the dosing device which results in a longer life for the device.

In a further embodiment of the invention, the dosing device may include vibrating means in the base of the dosing chamber. Suitable examples of vibrating means will be well known to those skilled in the art. For example, the base may comprise a flexible or deformable material which could, for example, be vibrated by a piezzo electric transducer. Such an embodiment is especially suitable for use in dosing devices adapted for dosing small amounts of particulate material, such a dosing device for use in a dental blasting apparatus.

The dosing device, and blasting apparatus, of the invention is suitable for dosing both non-abrasive material (such as that disclosed in International Patent Application No. WO 2004/084851) or for dosing more abrasive materials such as, for example, sand, or for dosing combinations thereof or indeed any type of particulate material for which controlled metering is required. It is suitable for industrial use in blasting apparatus or as a means of metering a particulate material in a processing plant such as a pharmaceutical manufacturing, and for other non-industrial uses such as dosing dental cleaning materials.

The invention is not limited to the embodiment hereinbefore described which may be varied in construction and detail without departing from the spirit of the invention.

The invention claimed is:

1. A particulate material blasting apparatus comprising a particulate material storage reservoir adapted to feed particulate material into a particulate material dosing device, the dosing device comprising:

a dosing chamber having a base, a material receiving side and a material delivery side;

a feed conduit adapted to receive material from the particulate material reservoir and feed the material onto a base of the dosing chamber at a receiving side of the dosing chamber;

a delivery conduit formed in the dosing chamber at delivery side of the dosing chamber; and a rotor rotatably mountable with the chamber, the rotor comprising a series of scooping pockets mounted along a circumference of the rotor, wherein the rotor is disposed within the dosing chamber such that upon rotation the pockets scoop-up material from the base of the dosing chamber and deliver it up and around to the delivery side of the dosing chamber where it falls into the delivery conduit, wherein the base is disposed with respect to the feed conduit such that material delivered onto the base from the feed conduit will not spill into the delivery conduit, and wherein the blasting apparatus further includes an air pressure equalisation conduit adapted to provide pressure equalisation between the storage reservoir and the dosing chamber.

2. A particulate material blasting apparatus as claimed in claim 1 in which one end of the air pressure equalisation conduit is located within the particulate material storage reservoir adjacent a mouth of the storage reservoir.

3. A particulate material blasting apparatus as claimed in claim 2 in which the air pressure equalisation conduit comprises a further opening located within the particulate material storage reservoir adjacent a top of the storage reservoir.

4. A particulate material blasting apparatus as claimed in claim 1 in which the material feed conduit is formed by a baffle formed in the receiving side of the dosing chamber above the rotor, wherein a pressure equalisation gap is provided between a top of the baffle and a top of the dosing device.

5. A particulate material blasting apparatus as claimed in claim 1 and comprising at least two series of scooping pockets mounted along the circumference of the rotor, and in which the pockets of one series are circumferentially staggered with respect the pockets of the other series.

6. A particulate material blasting apparatus as claimed in claim 1 and comprising a plurality of rotors, in which the scooping pockets of one rotor are circumferentially staggered with respect to those of the other rotor(s).

7. A particulate material blasting apparatus as claimed in claim 1, in which the pockets are formed by tooth-like formations which project from the circumference of the rotor.

8. A particulate material blasting apparatus as claimed in claim 1 in which the air pressure is equalised throughout the apparatus.

9. A method of dosing particulate material which employs a particulate material blasting apparatus according to claim 1, which method comprises the steps of providing a reservoir of particulate material, feeding the particulate material into the dosing chamber through the feed conduit, actuating the motor to rotate the rotor at a desired speed corresponding to the desired material dosing rate, and carrying out a blasting operation by employing a nozzle to direct the stream of fluid and particulate material at a desired target.

* * * * *